US010808391B2

(12) United States Patent
Bhatia et al.

(10) Patent No.: US 10,808,391 B2
(45) Date of Patent: Oct. 20, 2020

(54) TRENCHING UNIT, TRENCHING BODY AND INSERT

(71) Applicant: ACO SEVERIN AHLMANN GMBH & CO KOMMANDITGESELLSCHAFT, Budelsdorf (DE)

(72) Inventors: Ramon Bhatia, Rendsburg (DE); Jan Mieze, Kiel (DE)

(73) Assignee: ACO SEVERIN AHLMANN GMBH & CO. KOMMANDITGESELLSCHAFT, Budelsdorf (DE)

( * ) Notice: Subject to any disclaimer, the term of this patent is extended or adjusted under 35 U.S.C. 154(b) by 0 days.

(21) Appl. No.: 16/491,309

(22) PCT Filed: Mar. 7, 2018

(86) PCT No.: PCT/EP2018/055557
§ 371 (c)(1),
(2) Date: Sep. 5, 2019

(87) PCT Pub. No.: WO2018/162530
PCT Pub. Date: Sep. 13, 2018

(65) Prior Publication Data

US 2020/0056361 A1 Feb. 20, 2020

(30) Foreign Application Priority Data

Mar. 9, 2017 (DE) ..... 10 2017 105 002

(51) Int. Cl.
*E03F 5/00* (2006.01)
*E03F 1/00* (2006.01)
*E02B 11/00* (2006.01)

(52) U.S. Cl.
CPC ..... *E03F 1/005* (2013.01); *E02B 11/005* (2013.01)

(58) Field of Classification Search
CPC ..... E03F 1/005; E03F 1/002; E03F 5/0401; E03F 1/00; E02B 11/005; Y02A 10/33
See application file for complete search history.

(56) References Cited

U.S. PATENT DOCUMENTS 7,591,610 B2 * 9/2009 Krichten ..... E03F 1/005 405/50
2012/0255624 A1 10/2012 Canney et al.
(Continued)

FOREIGN PATENT DOCUMENTS

CN 104790463 A 7/2015
CN 304151996 S 5/2017
(Continued)

OTHER PUBLICATIONS

The International Search Report and Written Opinion issued in corresponding International Patent Application No. PCT/EP2018/055557; dated Oct. 9, 2018.
(Continued)

*Primary Examiner* — Carib A Oquendo
(74) *Attorney, Agent, or Firm* — Pearne & Gordon LLP

(57) ABSTRACT

The invention relates to a trenching unit having at least two trenching bodies (10*a*, 10*b*), which each comprise an upper base plate (11), a lower base plate (12), and hollow columns (13*a*, 13*b*), which are arranged perpendicularly between the base plates (11, 12) and form column openings (14) in the base plates (11, 12), wherein the lower base plate (11) of the one trenching body (10*a*) and the upper base plate (12) of the other trenching body (10*b*) bear on one another in such a way that the column openings (14) of the two bearing base plates (11, 12) are arranged concentrically. It is characterized in that the trenching bodies (10*a*, 10*b*) are connected by at
(Continued)

least one adapter (15), which comprises a bearing surface (16) and two insert profiles (17*a,* 17*b*), which are arranged on both sides of the bearing surface (16) and are connected thereto, wherein the bearing surface (16) is arranged between the bearing base plate (11, 12) and the insert profiles (17*a,* 17*b*) are inserted into two concentrically arranged column openings (14) of the bearing base plates (11, 12).

12 Claims, 5 Drawing Sheets

(56) References Cited

U.S. PATENT DOCUMENTS

| | | | | |
|---|---|---|---|---|
| 2014/0369757 | A1* | 12/2014 | Meincke | E03F 1/005 405/36 |
| 2015/0016874 | A1 | 1/2015 | Wandkowski et al. | |
| 2015/0017384 | A1 | 1/2015 | Wichmann et al. | |
| 2016/0265209 | A1* | 9/2016 | Graf | E03F 1/005 |

FOREIGN PATENT DOCUMENTS

| | | | |
|---|---|---|---|
| CN | 304206586 | S | 7/2017 |
| DE | 102009044412 | A1 | 4/2011 |
| DE | 102012100555 | A1 | 7/2013 |
| EP | 1416099 | A2 | 5/2004 |
| EP | 1416099 | * | 6/2004 |
| EP | 2463449 | A1 | 6/2012 |
| EP | 2495373 | A2 | 9/2012 |
| WO | 2011004508 | A1 | 1/2011 |

OTHER PUBLICATIONS

Office Action issued in corresponding Chinese Application No. 2018800161137; dated May 28, 2020.

Examination Report No. 1 issued in corresponding Australian Patent Application No. 2018229753; dated Jun. 29, 2020.

* cited by examiner

TRENCHING UNIT, TRENCHING BODY AND INSERT

The invention relates to a trenching unit having the features of the preamble of claim 1. Such a trenching unit is known, for example, from DE 10 2009 044 412 A1. The invention furthermore relates to a trenching body and an adapter for a trenching unit.

Using trenching systems to drain surfaces is known, wherein the water to be drained enters the trenching system through the surface and is drained from there, for example, into a water treatment facility. For this purpose, trenching systems comprise trenching bodies, the boundary walls of which are water-permeable. The stability of the trenching systems is determined by the columns or pylons arranged in the interior of the trenching body, which connect the base plates of the trenching body to one another. In practice, trenching bodies are stacked one on top of another to achieve sufficient drainage depth. It is important in this case for the trenching bodies stacked one on top of another to provide the system as a whole with sufficient stability.

The invention is based on the object of specifying a trenching unit which is sufficiently stable even in the case of larger dimensions of the trenching unit, i.e., in the case of at least two trenching bodies stacked one on top of another. The invention is furthermore based on the object of specifying a trenching body and an adapter for a trenching unit.

This object is achieved according to the invention by the trenching unit as claimed in claim 1. The object is achieved by the other independent claims 14 and 15 with respect to the trenching body and the adapter for a trenching unit.

In particular, the object is achieved by a trenching unit having at least two trenching bodies, which each comprise an upper base plate, a lower base plate, and hollow columns. The hollow columns are arranged perpendicularly between the base plates and form column openings in the base plates. The lower base plate of the one trenching body and the upper base plate of the other trenching body bear on one another in such a way that the column openings of the two bearing base plates are arranged concentrically. The trenching bodies are connected by at least one adapter, which comprises a bearing surface and two insert profiles, which are arranged on both sides of the bearing surface and connected thereto. The bearing surface is arranged between the bearing base plates. The insert profiles are inserted into two concentrically arranged column openings of the bearing base plates.

The invention has the advantage that the stability of the trenching unit is improved. It is thus possible to stack a nearly arbitrary number of trenching bodies one on top of another without the risk existing that the trenching bodies will slip in relation to one another. The invention forms a slip safeguard, so that the transverse forces acting on the trenching unit are safely dissipated without the trenching body slipping. It is thus possible to vary the height of the trenching unit to enhance the drainage performance of the trenching unit.

Preferred embodiments of the invention are specified in the dependent claims.

The insert profiles can thus be inserted in a formfitting manner into the column openings.

The insert profiles can be formed at least partially symmetrically, in particular completely symmetrically. On the one hand, the production is thus simplified. On the other hand, the insert profiles can be used in both directions. An incorrect installation of the insert profiles is thus practically precluded, since both sides of the adapter fit both into the upper and also into the lower base plate.

In one preferred embodiment, the insert profiles each have multiple plug-in blocks. The plug-in blocks can be oriented in different directions to achieve a corresponding supporting action in these directions. The arrangement of the plug-in blocks is arbitrary as long as an insert profile results which can be connected in a formfitting manner to the concentrically arranged column openings of the bearing base plates.

The plug-in blocks are preferably arranged in a cross shape. The stability of the trenching unit in the main load directions is thus enhanced.

The plug-in blocks can each comprise reinforcing ribs, which are arranged in a cross shape. By way of the combination with the plug-in blocks arranged in a cross shape, a double cross-shaped configuration results, whereby the stability of the trenching unit is further enhanced.

In one preferred embodiment, the insert profiles each have contact surfaces, which abut the inner side of the hollow columns to form the formfitting connection, wherein the contour of the contact surfaces is adapted to the contour of the inner side of the hollow columns. In this manner, surface forces can be transmitted to the hollow columns via the adapters, whereby the force introduction and thus the stability of the trenching unit is improved.

The contour of the contact surfaces is preferably formed wavy. It has been shown that a particularly stable hold is thus achieved in the case of a corresponding wavy inner profile of the hollow columns.

The bearing surface of the adapter can substantially be formed in the shape of a ring, the external diameter of which is larger than the diameter of the column openings. This embodiment has the advantage that the adapter is fixed by the weight force of the upper trenching body.

The plug-in blocks are preferably connected to the ring and thus fixed in the radial direction. In addition, the plug-in blocks can be connected to one another, specifically both in the radial and also in the axial directions of the adapter, whereby the stability of the adapter is enhanced.

In a further preferred embodiment, multiple adapters are connected to one another, wherein the position of the adapters corresponds to the location of the column openings. This embodiment improves the ability to handle the adapters, because multiple adapters can be connected simultaneously to various column openings. It is thus not necessary to align the individual adapters and connect them separately to individual column openings.

In the scope of the invention, the adapter for the trenching unit having at least two trenching bodies is also disclosed and claimed as such, i.e., independently of the trenching unit. In addition, a trenching body is disclosed and claimed in the scope of the invention, in which the adapter covers at least one column opening in the upper base plate to form a continuously traversable surface.

In contrast to the adapter having the insert profiles arranged on both sides of the support surface, the above-mentioned adapter is not provided for connecting two trenching bodies, but rather for covering a column opening. The upper side of the adapter is accordingly flat to enable unobstructed traversal of the upper side of the trenching body. For this purpose, the adapter has only one single insert profile, which is inserted into the column opening and has plug-in blocks arranged in a cross shape, which align with main ribs of the upper base plate in at least 2 directions extending perpendicularly in relation to one another.

The aligned arrangement has the advantage that forces introduced into the reinforcing ribs are introduced optimally into the main ribs of the upper base plate. The same applies in reverse. The stability of the trenching body is thus improved by the adapter. The above-mentioned aligned arrangement of the plug-in blocks is also disclosed and claimed in conjunction with the adapter for connecting two trenching bodies.

The invention will be explained in greater detail hereafter with further details on the basis of exemplary embodiments with reference to the appended figures.

In the figures

In the following description, the same reference signs are used for identical and identically-acting parts.

Figure 1:
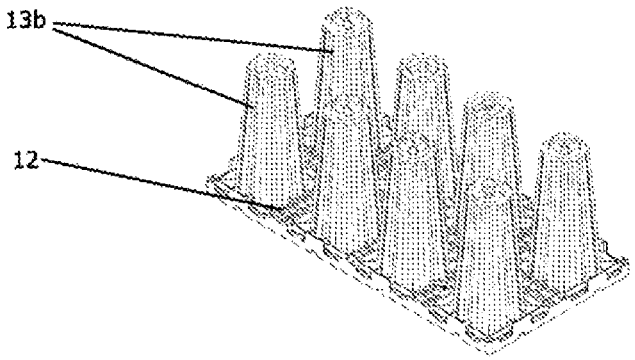
FIG. 1 shows a perspective view of a lower base plate for a trenching body having multiple hollow columns.
Figure 2:
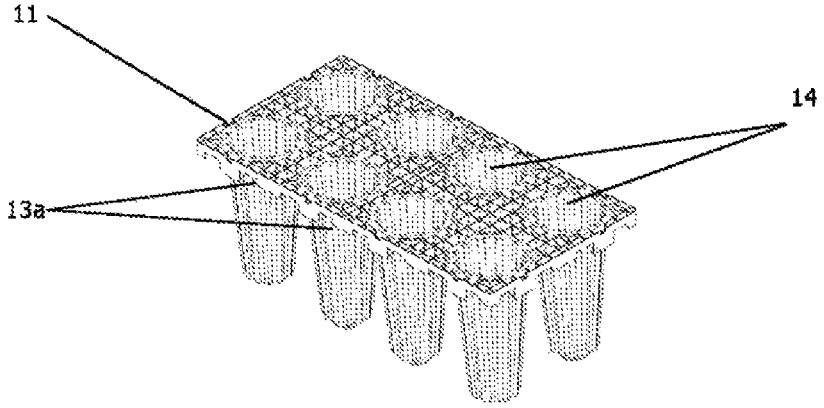
FIG. 2 shows a perspective view of an upper base plate for a trenching body having multiple hollow columns, which is connectable to the base plate according to FIG. 1 to form a trenching body.

The base plates 11, 12 shown in FIGS. 1 and 2 form the base elements of a trenching body. The trenching body is a box-shaped body having grid-type boundary surfaces, through which water can flow into the trenching body. The trenching body can be wrapped in a known manner using a geotextile to prevent the penetration of sediments into the trenching system.

A trenching system composed of such trenching bodies is used, on the one hand, as a block accumulator for precipitation water and, on the other hand, as a block infiltration for precipitation water. The basis of this system are the identical base plates shown in FIGS. 1, 2, which can be combined with one another in different ways. The upper base plate 11 is arranged on top in the laid state of the trenching system and the lower base plate 12 is arranged on the bottom. The base plates each comprise hollow columns 13*a*, 13*b*, which extend perpendicularly in relation to the base plates 11, 12 and are connected thereto. The hollow columns 13*a*, 13*b* form spacers, which establish the spacing of the base plates 11, 12 in relation to one another. For this purpose, the hollow columns 13*a*, 13*b* are placed one on another with the free ends thereof. The hollow columns 13*a*, 13*b*, also called pylons, are formed conical, wherein the smaller cross-sectional opening forms the free end and the larger cross-sectional opening forms the end of the respective hollow column 13*a*, 13*b* connected to the respective base plate 11, 12. The hollow columns 13*a*, 13*b* form column openings 14 in the respective base plate 11, 12, as can be seen well in FIG. 2.

Figure 5:
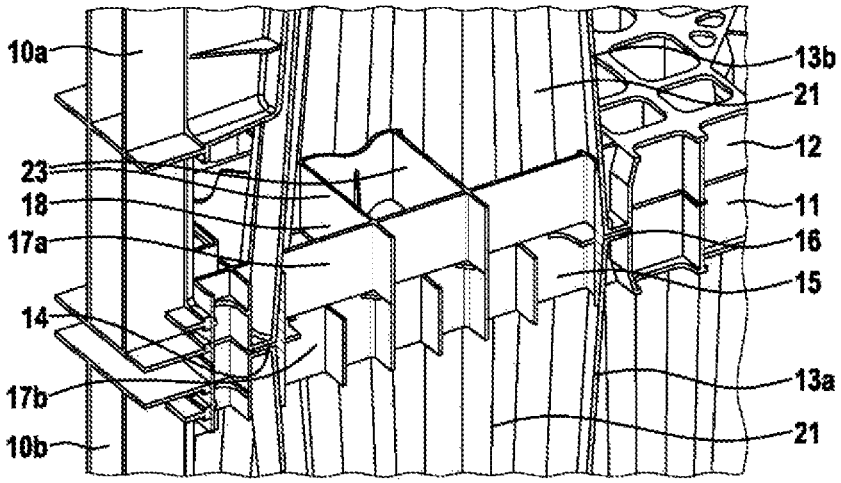
FIG. 5 shows a cross section through two trenching bodies which are connected at the base plates by an adapter.

To increase the height of the trenching system, it is typical for multiple layers of trenching bodies 10*a*, 10*b* to be stacked one on top of another (see FIG. 5). In this case, a lower base plate 12 of the upper trenching body 10*a* comes into contact with an upper trenching plate 11 of the trenching body 10*b* located underneath.

Figure 3:
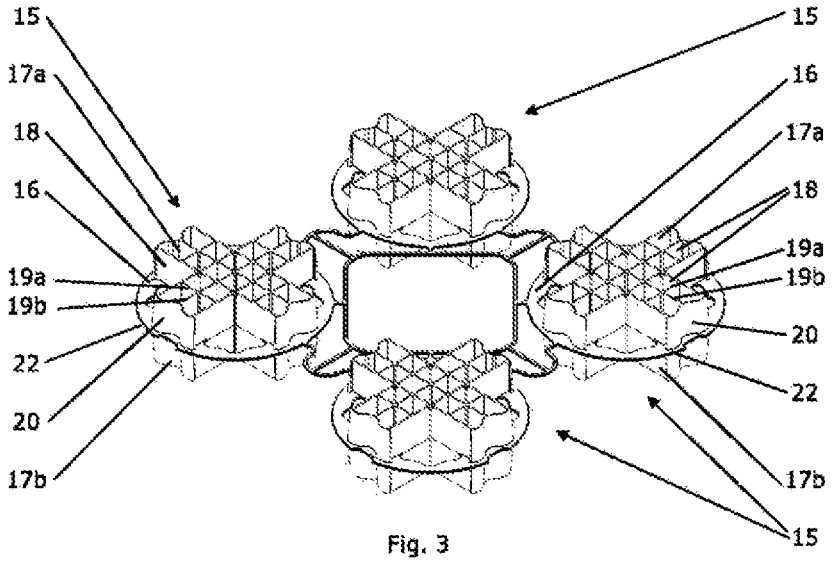
FIG. 3 shows a perspective view of multiple adapters according to one exemplary embodiment according to the invention, which is used for connecting multiple, in particular two trenching bodies.

The invention begins here, which, as shown on the basis of the exemplary embodiment according to FIG. 3, improves the connection between the trenching bodies 10*a*, 10*b* stacked one on top of another.

Figure 4:
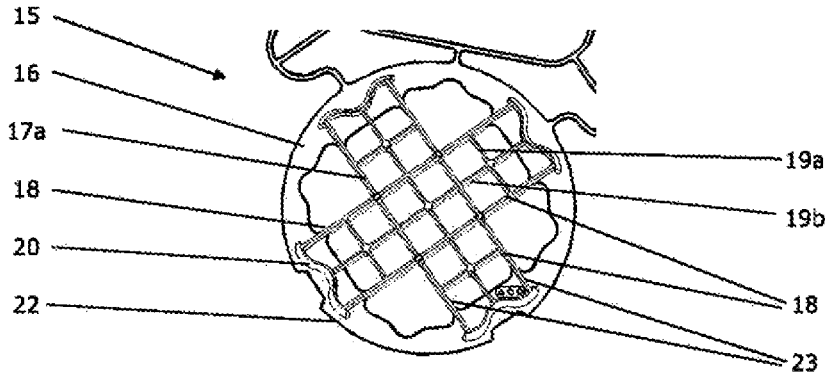
FIG. 4 shows a top view of an adapter according to FIG. 3.

For this purpose, an adapter 15 is provided, which is shown in FIGS. 3, 4. The adapter 15 comprises a bearing surface 16 and two insert profiles 17*a*, 17*b*. As can be seen well in FIGS. 3 and 5, the insert profiles 17*a*, 17*b* are arranged on both sides of the bearing surface 16. In other words, the bearing surface 16 is located between the upper insert profile 17*a* and the lower insert profile 17*b*. The insert profiles 17*a*, 17*b* are designed to absorb the occurring horizontal loads in the (main) directions parallel to the main surfaces of the base bodies 11, 12. For this purpose, they have a cross-shaped structure having ribs, which follows the corresponding ribs of the base plates 11, 12. The bearing surface 16 extends in the circumferential direction between the insert profiles 17*a*, 17*b*. Moreover, the bearing surface 16 protrudes radially beyond the insert profile 17*a*, 17*b*. It is thus possible that the bearing surface 16 bears on the upper side of the respective base plate 11, 12 and is fixed by the weight of the upper trenching body.

The insert profiles 17*a*, 17*b* are formed symmetrically and each comprise multiple plug-in blocks 18. The plug-in blocks 18 are used to establish the formfitting connection to the hollow columns 13*a*, 13*b* and/or column openings 14. The plug-in blocks 18 each comprise walls 23, which laterally delimit the plug-in blocks 18. As shown in FIG. 4, the plug-in blocks 18 are arranged in a cross shape, wherein four plug-in blocks 18 are arranged around a middle plug-in block 18. Other arrangements of the plug-in blocks 18 are possible. The plug-in blocks 18 are formed essentially cuboid. Other geometries of the individual plug-in blocks 18 are possible.

The end faces of the plug-in blocks 18, i.e., the free ends of the plug-in blocks 18, each comprise a contact surface 20, which abuts the inner wall or the inner side 21 of the respective hollow column 13*a*, 13*b* in the installed state (see FIG. 5). Specifically, the contact surfaces 20 are formed wavy. Other geometries are also possible here. The contact surfaces 20 advantageously extend beyond the plug-in blocks 18, so that a surface pressure can be reduced in the region between the contact surfaces 20 and the inner sides 21 of the hollow columns 13*a*, 13*b*. In this manner, the occurring horizontal forces can be transmitted as a surface load instead of as a linear load. Larger forces can be transmitted due to the transmission of the horizontal forces as a surface load instead of as a linear load.

First and second reinforcing ribs 19*a*, 19*b* are arranged in a cross shape between the walls 23 of the plug-in blocks 18.

The bearing surface 20 is formed in the exemplary embodiment according to FIGS. 3, 4 as a ring 22, the external diameter of which is somewhat larger than the diameter of the column openings 14. The bearing surface 16 can thus bear on the respective base plate 11, 12 when the adapter 15 is inserted into the opening 14. The ring-shaped bearing surface 20 can comprise one or more recesses to provide guides for packing straps when packing, for example, on a pallet. The ribs of the insert profiles comprise complementary recesses or elevations to enable a simplified stacking capability of multiple adapters 15.

The internal diameter of the ring 22 approximately corresponds to the internal diameter of the hollow columns 13*a*, 13*b*.

As shown in FIG. 3, four identical adapters 15 are assembled to form a coherent composite, wherein the adapters 15 are connected to one another by webs. The composite can be installed uniformly. The individual adapters 15 are elastically connected to one another in this case to be able to compensate for possible tolerances of the base body per se and/or of the base body in the installation situation.

It can be seen well in FIG. 5 that the lower base plate 12 of the upper trenching body 10*a* is connected to the upper base plate 11 of the lower trenching body 10*b*. The connection is performed by the above-described adapter 15, which is arranged in the column opening 14. In this case, the contact surface 20 of the plug-in block 18 abuts the inner wall 21 of the lower hollow column 13*b*. The two base plates 11, 12 are fixed in location and cannot slip because of the adapter part 15. The degree of engagement with the respective hollow columns 13*a*, 13*b* can be varied via the height of the adapter 15, wherein the conicity of the hollow columns 13*a*, 13*b* is to be taken into consideration with increasing height.

Figure 6:
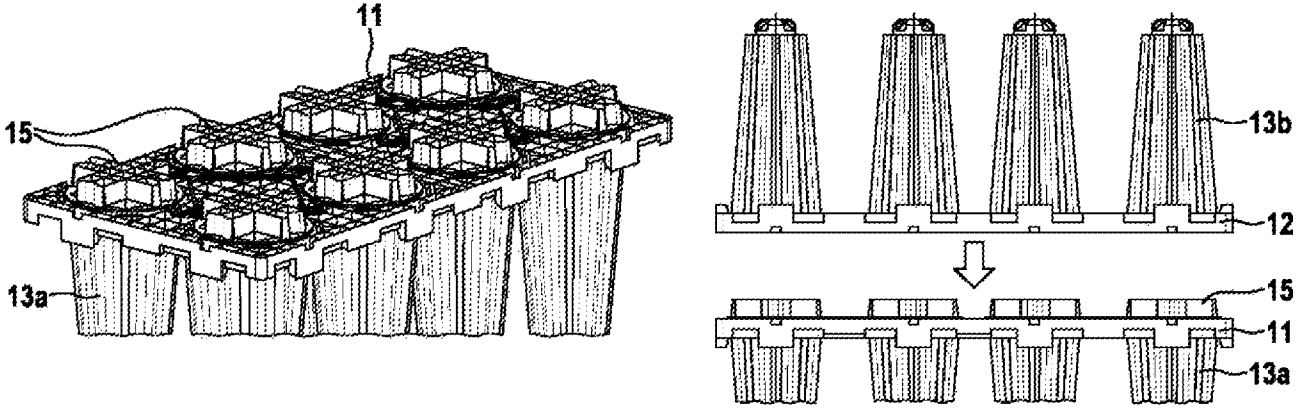
FIG. 6 shows the trenching bodies according to FIGS. 1, 2 and the adapters according to FIG. 3 during the connection of the base plates.

As shown in FIG. 6, before the connection of the trenching bodies, the adapters 15 are inserted into the column openings 14, so that the insert profiles 17*a* are engaged with the column openings 14 and/or the hollow columns 13*a* (left illustration in FIG. 6). A further base plate, in the example according to FIG. 6 the lower base plate 12 of the upper trenching body 10*a*, is then placed on the adapters 15. For this purpose, the column openings 14 of the two base plates 11, 12 are aligned concentrically in relation to one another. The overall alignment of the two base plates 11, 12 is established precisely and securely by the location of the adapters 15.

Figure 7:
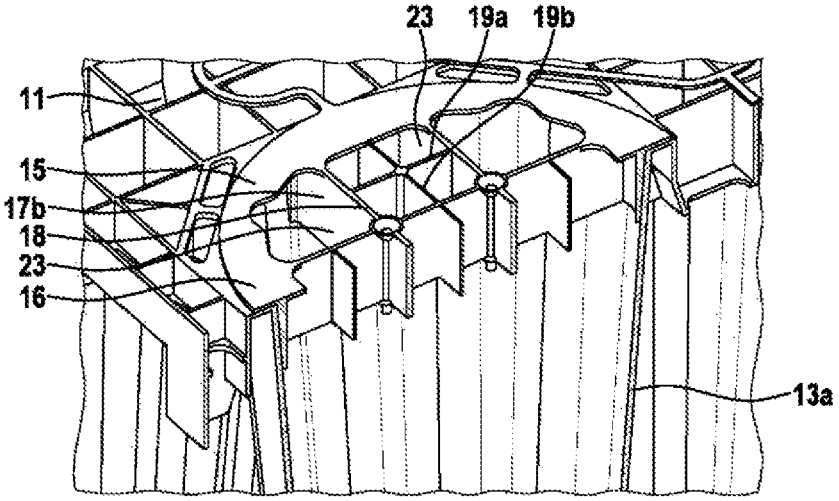
FIG. 7 shows a section through the upper base plate having only one single insert profile for covering the column opening.

An alternative to the adapter 15 functioning as a connector is shown in FIG. 7. This adapter 15 is a cover, in which the adapter 15 only comprises a single insert profile 17*a* having plug-in blocks 18 on its lower side. The side walls 23 of the plug-in blocks 18 align with the main ribs 24 of the base plate (see FIG. 8). Specifically, the walls 23 align in two directions extending perpendicularly to one another, so that a maximum stability results in the main load directions. The arrangement of the walls 23 is possible both in the example according to FIG. 7 and also in the example according to FIGS. 3 to 6.

Figure 8:
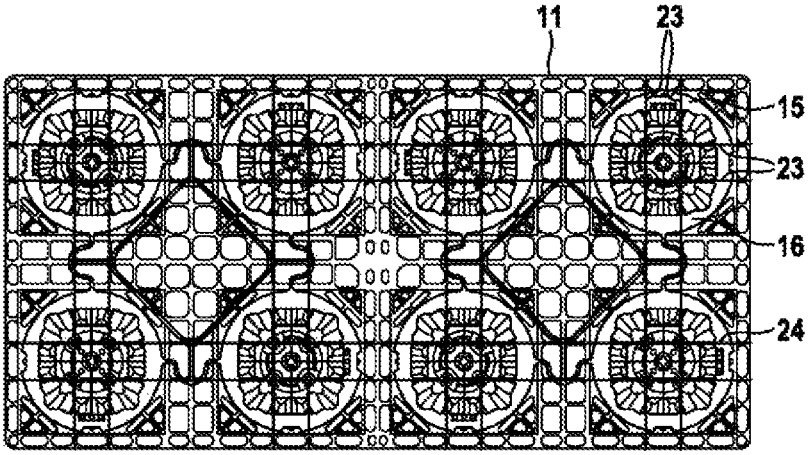
FIG. 8 shows a top view of the upper base plate of a trenching body made of multiple adapters, in which the plug-in blocks and the main ribs of the base plate align.

The aligned arrangement is shown in FIG. 8, in which virtual lines are drawn along the main ribs 24. As a result, the walls 23 align with the main ribs 24 in both main directions of the base plate 11.

LIST OF REFERENCE SIGNS

10*a* first trenching body
10*b* second trenching body
11 upper base plate
12 lower base plate
13*a* upper hollow column
13*b* lower hollow column
14 column openings
15 adapter
16 bearing surface
17*a* upper insert profile
17*b* lower insert profile
18 plug-in blocks
19*a* first reinforcing ribs
19*b* second reinforcing rib
20 contact surfaces
21 inner side of the hollow column
22 ring
23 side walls of the plug-in blocks
24 main ribs

The invention claimed is:

1. A trenching unit comprising at least two trenching bodies (10*a*, 10*b*), each of the at least two trenching bodies (10*a*, 10*b*) comprises an upper base plate (11), a lower base plate (12), and hollow columns (13*a*, 13*b*), the hollow columns (13*a*, 13*b*) are arranged perpendicularly between the upper and lower base plates (11, 12) and form column openings (14) in the upper and lower base plates (11, 12), wherein the lower base plate (11) of one of the at least two trenching bodies (10*a* 10*b*) and the upper base plate (12) of an another one of the at least two trenching bodies (10*a* 10*b*) bear on one another and the column openings (14) of the two bearing upper and lower base plates (11, 12) are arranged concentrically, the at least two trenching bodies (10*a*, 10*b*) are connected by at least one adapter (15), the at least one adapter (15) comprises a bearing surface (16) and two insert profiles (17*a*, 17*b*) that are arranged on both sides of the bearing surface (16) and are connected thereto, wherein the bearing surface (16) is arranged between the upper and lower base plates (11, 12) and the two insert profiles (17*a*, 17*b*) are inserted in a form-fitting manner into two concentrically arranged column openings (14) of the bearing upper and lower base plates (11, 12)), the two insert profiles (17*a*, 17*b*) each comprise a contact surface (20) that abuts an inner side (21) of the hollow columns, the contact surface (20) is contoured to the inner side (21) of the hollow columns.

2. The trenching unit of claim 1, wherein the insert profiles (17*a*, 17*b*) are formed symmetrically.

3. The trenching unit of claim 1, wherein the insert profiles (17*a*, 17*b*) each comprise multiple plug-in blocks (18).

4. The trenching unit of claim 3, wherein the plug-in blocks (18) are arranged in a cross shape.

5. The trenching unit of claim 4, wherein the plug-in blocks (18) each comprise reinforcing ribs (19*a*, 19*b*) arranged in a cross shape.

6. The trenching unit of claim 1, wherein the contour of the contact surfaces (20) is formed wavy.

7. The trenching unit of claim 1, wherein the contact surface (20) of the adapter (15) is formed substantially in the form of a ring (23), the external diameter of the ring (23) is larger than the diameter of the column openings (14).

8. The trenching unit of claim 7, wherein the plug-in blocks (18) are connected to the ring (23).

9. The trenching unit of claim 3, wherein the plug-in blocks (18) are connected to one another.

10. The trenching unit of claim 4, wherein the plug-in blocks (18) arranged in a cross shape are aligned with main ribs of the upper base plate (12) in at least two directions extending perpendicularly in relation to one another.

11. The trenching unit of claim 1, wherein multiple adapters (15) are connected to one another, wherein the position of the adapters (15) corresponds to the location of the column openings (13*a*, 13*b*).

12. An adapter for a trenching unit comprising at least two trenching bodies (10*a*, 10*b*), each of the at least two trenching bodies (10*a*, 10*b*) comprise an upper base plate (11), a lower base plate (12), and hollow columns (13*a*, 13*b*), the hollow columns (13*a*, 13*b*) are arranged perpendicularly between the upper and lower base plates (11, 12) and form column openings (14) in the upper and lower base plates (11, 12), wherein the adapter comprises a bearing surface (16) and two insert profiles (17*a*, 17*b*), the two insert profiles (17*a*, 17*b*) are arranged on both sides of the bearing surface (16) and are connected thereto, wherein the two insert profiles (17*a*, 17*b*) are insertable in a form-fitting manner into the hollow columns (13*a*, 13*b*) to connect the trenching bodies (10*a*, 10*b*) and the bearing surface (16) protrudes outward beyond the two insert profiles (17*a*, 17*b*), the two insert profiles (17*a*, 17*b*) each comprise a contact surface (20) that abuts an inner side (21) of the hollow columns, the contact surface (20) is contoured to the inner side (21) of the hollow columns.

* * * * *